US010295917B2

(12) United States Patent
Suzuki et al.

(10) Patent No.: US 10,295,917 B2
(45) Date of Patent: May 21, 2019

(54) ELECTROPHOTOGRAPHIC ROLLER, PRODUCTION METHOD THEREFOR, AND ELECTROPHOTOGRAPHIC APPARATUS

(71) Applicant: CANON KABUSHIKI KAISHA, Tokyo (JP)

(72) Inventors: Toshiro Suzuki, Gotemba (JP); Satoru Yamada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 15/371,072

(22) Filed: Dec. 6, 2016

(65) Prior Publication Data

US 2017/0168404 A1 Jun. 15, 2017

(30) Foreign Application Priority Data

Dec. 9, 2015 (JP) ..... 2015-240440

(51) Int. Cl.

| | |
|---|---|
| ***G03G 5/04*** | (2006.01) |
| ***G03G 15/02*** | (2006.01) |
| ***G03G 15/08*** | (2006.01) |
| ***G03G 15/16*** | (2006.01) |

(52) U.S. Cl.

CPC ..... *G03G 5/04* (2013.01); *G03G 15/0233* (2013.01); *G03G 15/0818* (2013.01); *G03G 15/1685* (2013.01)

(58) Field of Classification Search

CPC ..... G03G 5/04; G03G 5/05; G03G 5/0525; G03G 5/8278; G03G 15/75; G03G 15/751

See application file for complete search history.

(56) References Cited

U.S. PATENT DOCUMENTS

| | | | | |
|---|---|---|---|---|
| 5,550,618 A * | 8/1996 | Herbert | G03G 5/10 399/159 |
| 8,905,402 B2 * | 12/2014 | Saito | B65H 27/00 271/272 |
| 2002/0141781 A1 * | 10/2002 | Litman | B29C 44/582 399/159 |
| 2016/0139530 A1 * | 5/2016 | Iwasaki | G03G 15/0225 399/175 |

FOREIGN PATENT DOCUMENTS

| | | |
|---|---|---|
| JP | 2006-289496 A | 10/2006 |
| JP | 2007-025196 A | 2/2007 |
| JP | 2010-184806 A | 8/2010 |

* cited by examiner

*Primary Examiner* — David M. Gray
*Assistant Examiner* — Andrew V Do
(74) *Attorney, Agent, or Firm* — Canon U.S.A., Inc. IP Division

(57) ABSTRACT

Provided is an electrophotographic roller including a cylindrical base and an elastic layer on an outer peripheral surface of the base, the base having a joint extending from one end to the other end in a longitudinal direction thereof, at least a part of the joint has a gap penetrating the joint in a thickness direction of the base, and a part of a material for the elastic layer entering the gap and covering a portion of an inner peripheral surface of the base near the gap to form an anchor portion of the elastic layer.

9 Claims, 9 Drawing Sheets

ELECTROPHOTOGRAPHIC ROLLER, PRODUCTION METHOD THEREFOR, AND ELECTROPHOTOGRAPHIC APPARATUS

BACKGROUND

Field of the Disclosure

The present disclosure relates to an electrophotographic roller for use in an electrophotographic apparatus adopting electrophotography, such as a laser printer, a copying machine, or a facsimile, a production method for the electrophotographic roller, and an electrophotographic apparatus.

Description of the Related Art

With recent improvements in speed and durability of electrophotographic apparatuses, electrophotographic rollers used in the electrophotographic apparatuses are required to have higher accuracy and higher durability. Here, a typical example of an electrophotographic system obtains an image through a step of applying potential to a surface of a photosensitive member using a photosensitive (photoconductive) substance (charging step), a step of forming an electric latent image by partly exposing the surface of the photosensitive member (exposure step), a step of developing the latent image with toner into a visible toner image (developing step), a step of transferring the toner image onto a recording material such as paper (transfer step), and a step of fixing the toner image on the recording material by heat and pressure (fixing step). A supplementary step, for example, a step of removing toner base particles and external additives, which are not transferred onto the recording material, but remain on the surface of the photosensitive member, from the surface of the photosensitive member by various methods (cleaning step) is sometimes added.

In these steps, an electrophotographic roller having an elastic layer is generally used. By rotating the electrophotographic roller, toner, external additives, and paper dust are prevented from being locally attached to the electrophotographic roller. This reduces image defects.

While such an electrophotographic roller generally has an elastic layer on a solid base, it has been proposed to use a cylindrical base instead of the solid base for the purpose of weight and cost reduction. For example, Japanese Patent Laid-Open No. 2006-289496 proposes to use a cylindrical shaft (cylindrical base) formed by bending a metal plate instead of the solid base.

The cylindrical base has a joint extending from one end to the other end in its longitudinal direction, and the joint sometimes has a gap (groove). Japanese Patent Laid-Open No. 2007-025196 proposes to form an elastic layer after filling a gap in a joint with filler. In this case, unevenness of conveying speed of a recording material is rarely caused by thermal expansion in the joint of the cylindrical base. Also, when the elastic layer is formed, the material of the elastic layer is prevented from leaking to the inside of a hollow shaft through the gap. Japanese Patent Laid-Open No. 2010-184806 proposes that, when a high-friction layer containing inorganic particles is formed, a gap is filled with fine inorganic particles. This avoids unevenness of the conveying speed at the joint, and prevents the material of the inorganic particles from entering the inside of a hollow shaft through the gap.

SUMMARY

The present disclosure aims to cure the deficiencies in the existing art by providing an electrophotographic roller in which separation between a base and a conductive elastic layer is minimized.

Furthermore, it is an aspect of the present disclosure to provide a production method for an electrophotographic roller in which a defect is rarely caused in an electrophotographic image.

A further aspect of the present disclosure is directed to providing an electrophotographic apparatus that contributes to formation of a high-quality electrophotographic image.

According to an aspect of the present disclosure, there is provided an electrophotographic roller including a cylindrical base and an elastic layer on an outer peripheral surface of the base. The base has a joint extending from one end to the other end in a longitudinal direction thereof. At least a part of the joint has a gap penetrating the joint in a thickness direction of the base. A part of a material for the elastic layer enters the gap and covers a portion of an inner peripheral surface of the base near the gap to form an anchor portion of the elastic layer.

According to another aspect of the present disclosure, there is provided a production method for an electrophotographic roller including a cylindrical base and an elastic layer provided on an outer peripheral surface of the base. The base has a joint extending from one end to the other end in a longitudinal direction thereof. At least a part of the joint has a gap penetrating the joint in a thickness direction of the base. A part of a material for the elastic layer enters the gap and covers a portion of an inner peripheral surface of the base near the gap to form an anchor portion of the elastic layer. The production method includes:

(A) preparing the base; and (B) applying the material for the elastic layer onto the outer peripheral surface of the base and forming a layer of the material for the elastic layer.

Step (B) includes forming the anchor portion of the elastic layer by intruding a part of the material for the elastic layer into the inner peripheral surface side of the base through the gap to cover the portion of the inner peripheral surface of the base near the gap.

According to a further aspect of the present disclosure, there is provided an electrophotographic apparatus including the above-described electrophotographic roller.

Further features of the present disclosure will become apparent from the following description of exemplary embodiments with reference to the attached drawings.

BRIEF DESCRIPTION OF THE DRAWINGS

FIG. 1A is a perspective view of the electrophotographic roller, FIG. 1B is a front view of the electrophotographic roller, FIG. 1C is an example of a cross-sectional view of a portion that does not have a gap penetrating a joint of a cylindrical base, and FIG. 1D is an example of a cross-sectional view of a portion having a gap penetrating the joint of the cylindrical base.

DESCRIPTION OF THE EMBODIMENTS

Figure 1A:
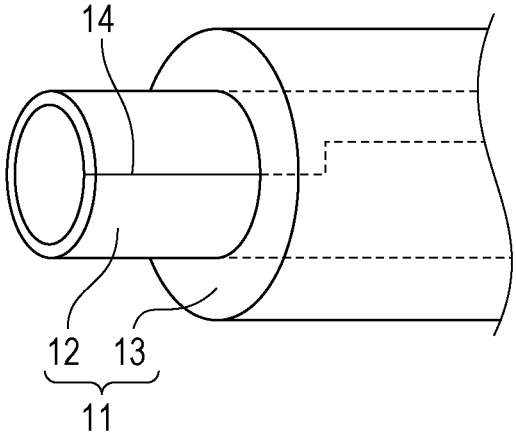
FIGS. 1A to 1D schematically illustrate an exemplary structure of an electrophotographic roller according to an embodiment of the present disclosure.
Figure 1B:
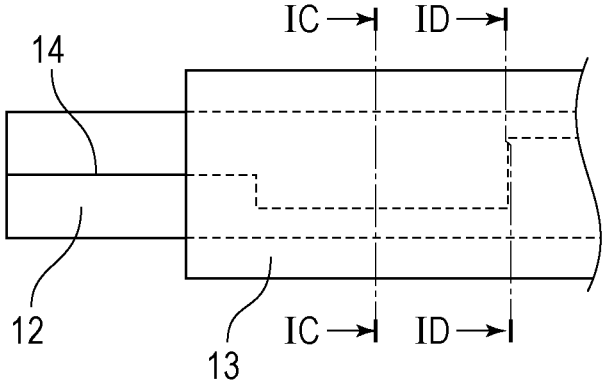
Figure 1C:
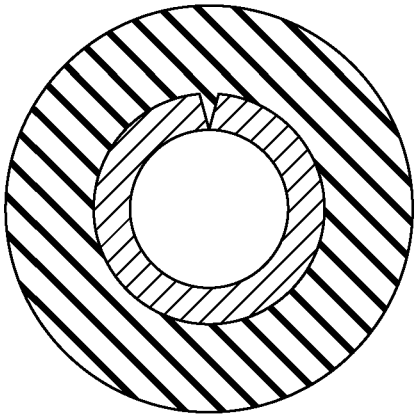
Figure 1D:
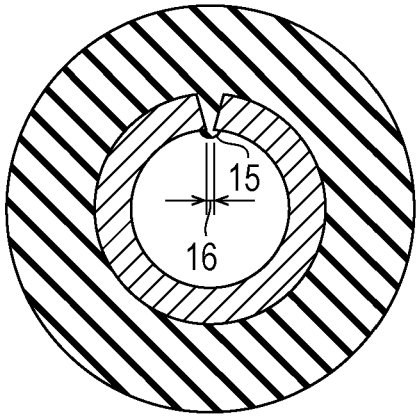

The present innovators examined the electrophotographic rollers described in Japanese Patent Laid-Open No. 2007-025196 and No. 2010-184806, and found that the elastic layer was sometimes separated from the base in the joint of the cylindrical base by great torque received during rotation and use for long time. When the conductive elastic layer separates from the base, resistance unevenness sometimes occurs in the electrophotographic roller. As a result, image density unevenness sometimes occurs owing to the roller shape and the resistance unevenness. Accordingly, the present innovators made intensive studies to prevent the conductive elastic layer from separating from the peripheral surface of the cylindrical base having the joint in the electrophotographic roller, and found that the electrophotographic roller according to the present disclosure could properly achieve the above objects.

An embodiment of the present disclosure will be described in detail below. As an electrophotographic roller according to the embodiment of the present disclosure, for example, the following rollers are given as examples:

- a charging roller configured to charge a photosensitive member in contact therewith;
- a developing roller configured to develop a latent image, which is electrically formed by exposing a surface of the photosensitive member, with toner;
- a toner supplying roller configured to supply predetermined toner to the developing roller and to scrape off residual toner from the developing roller; and
- a transfer roller configured to transfer a toner image onto a recording material such as paper.

FIGS. 1A to 1D illustrate a structure of an electrophotographic roller 11 according to an embodiment of the present disclosure. The electrophotographic roller 11 is composed of a cylindrical base 12 and an elastic layer 13 provided on an outer peripheral surface of the base 12. Here, reference numeral 14 denotes a joint of the cylindrical base 12. An anchor portion 15 of the elastic layer 13 covers a portion of an inner peripheral surface of the base 12 near a gap. The gap penetrating the joint 14 of the base 12 has a width 16.

Cylindrical Base

Figure 2:
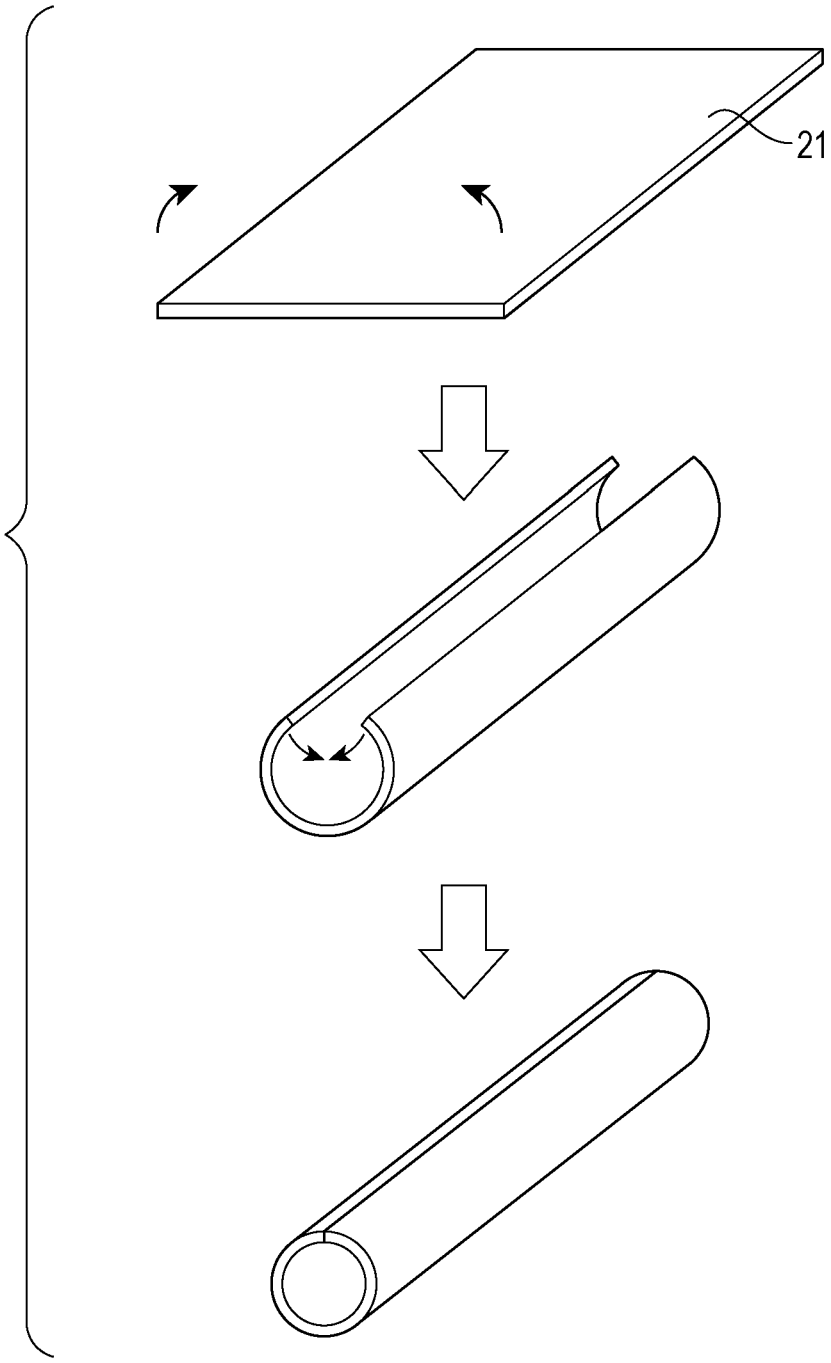
FIG. 2 schematically illustrates an exemplary production process of the cylindrical base in accordance with one or more embodiment of the present disclosure.

A cylindrical base according to the embodiment of the present disclosure has a joint extending from one end to the other end in its longitudinal direction. At least a part of the joint has a gap penetrating the joint in the thickness direction of the base. For example, such a base can be obtained by forming a metal plate 21 into a cylindrical shape by press working, as illustrated in FIG. 2. Specifically, a method including the following steps (1) and (2) can be adopted:

(1) forming a metal plate into a cylindrical shape by press working; and (2) forming a gap penetrating a base in the thickness direction in at least a part of a joint of the metal plate extending from one end to the other end of the cylinder in the longitudinal direction during the forming.

The base has the joint extending from one end to the other end in the longitudinal direction. The joint may be linearly shaped or may be shaped to have an uneven portion. A desired strength can be imparted to the base by forming a plurality of uneven portions in the joint. While the strength of the base increases as the number of uneven portions increases, the required strength for production of the base and product functions can be appropriately selected. Also, the thickness of the cylindrical base (thickness of the metal plate) can be appropriately selected in consideration of the strength required for production of the base and product functions. In consideration of the strength and cost, the cylindrical base preferably has a thickness within the range of 0.5 to 1.0 mm. While the uneven portions have, for example, a comb tooth shape, a sawtooth shape, or an arc tooth shape, the shape is not particularly limited.

Examples of the material of the base can include metals and alloys such as iron, copper, stainless steel, aluminum, an aluminum alloy, and nickel. The base may be subjected to surface treatment such as plating. As an example of plating, nickel plating or zinc plating is given.

In the base, at least a part of the joint has a gap penetrating the joint in the thickness direction of the base. This gap may continuously or discontinuously extend all over the length of the joint extending from one end to the other end in the longitudinal direction of the base. In consideration of the strength of the base, it is desirable that a portion having a gap and a portion having no gap should be mixed.

When the joint has a comb tooth shape or a sawtooth shape, it is desirable to form an escape of the metal plate in a meshed portion of the joint in the base for stable production using press working. In further consideration of mechanical strength of the base, it is desirable to form gaps in corner portions of the comb tooth shape or the sawtooth shape and not to form gaps in linear portions.

Figure 4:
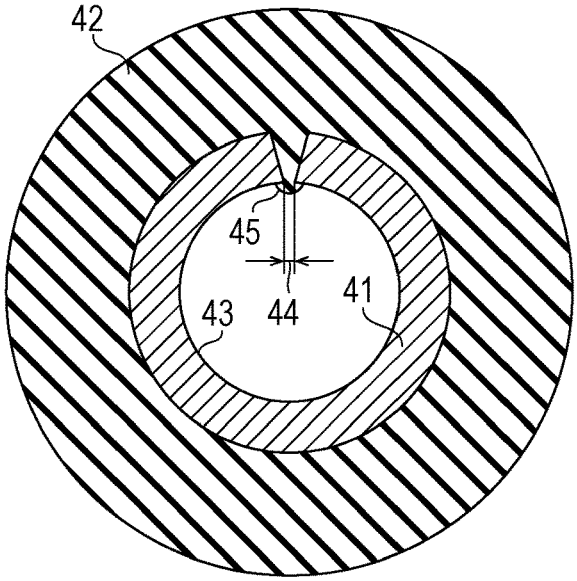
FIG. 4 is a schematic view of a cross section of an electrophotographic roller of an embodiment of the present disclosure (a cross section where an anchor portion is provided).

A width T (mm) (a width in the circumferential direction, reference numeral 44 in FIG. 4) of the gap penetrating the joint in the thickness direction of the base can be appropriately selected in consideration of the strength required for production of the base and product functions. The width T of the penetrating gap is preferably set to be within the range of 0.01 to 0.50 mm from the viewpoint that the material for the elastic layer can enter the gap and that the surface of the electrophotographic roller is not dented by entry of much material in the gap.

Elastic Layer

The material of the elastic layer is a mixture of a polymer and an external additive. The polymer is not particularly limited as long as it contains rubber. A specific example of the rubber material is a thermosetting rubber material in which a crosslinking agent is mixed in any of the following raw rubbers. Examples of raw rubbers include natural rubber (NR), isoprene rubber (IR), butadiene rubber (BR), styrenebutadiene rubber (SBR), butyl rubber (IIR), ethylene-propylene-diene terpolymer rubber (EPDM), an epichlorohydrin homopolymer (CHC), an epichlorohydrin-ethylene oxide copolymer (CHR), epichlorohydrin-ethylene oxide-allyl glycidyl ether terpolymer (CHR-AGE), an acrylonitrile-butadiene copolymer (NBR), a hydrogenated acrylonitrile-butadiene copolymer (H-NBR), chloroprene rubber (CR), acrylic rubber (ACM, ANM), silicone rubber (Si), urethane rubber (U), and a mixture of these rubbers.

A conductive agent can be used together to adjust the electric resistance value of the elastic layer. As the conductive agent, the following electronic conductive agent and ion conductive agents are given as examples. Examples of electronic conductive agents and ion conductive agents include a carbon material such as carbon black or graphite; an oxide such as titanium oxide and tin oxide; metal such as Cu or Ag, an electronic conductive agent such as conductive particles conducted with their surfaces covered with oxide or metal; an inorganic substance such as lithium perchlorate, sodium perchlorate, or calcium perchlorate; a cationic surfactant such as lauryltrimethylammonium chloride, stearyltrimethylammonium chroride, octadecyltrimethylammonium chroride, dodecyltrimethylammonium chloride, hexadecyltrimethylammonium chloride, trioctylpropylammonium bromide, or modified aliphatic dimethylethylammonium ethosulfate; an amphoteric surfactant such as lauryl betaine, stearyl betaine, or dimethylalkyl lauryl betaine; quaternary ammonium salts such as tetraethylammonium perchlorate, tetrabutylammonium perchlorate, or trimethyloctadecylammonium perchlorate; and organic acid lithium salts such as lithium trifluoromethanesulfonate. Further, spherical particles may be added to adjust the surface roughness of the elastic layer. The spherical particles may either be organic particles or inorganic particles.

For example, a filler, a processing aid, an aging resistance agent, a crosslinking aid, a crosslinking accelerator, a crosslinking accelerating aid, a crosslinking delaying agent, a dispersant, and a foaming agent, which are generally used as compounding agents for rubber, can be added as required. Examples of a method for mixing these materials can include a mixing method using a sealed mixer such as a Banbury mixer or a pressure kneader, and a mixing method using an open mixer such as an open roll.

Formation of Elastic Layer

The elastic layer is formed on the outer peripheral surface of the base by, for example, an extrusion molding method for extruding the base and the material for the elastic layer together from a crosshead, or an injection molding method for assembling two cylindrical plugs to both ends of a cylindrical die, injecting a rubber material into the cylindrical die while concentrically holding a base in the cylindrical die, and setting the rubber material by heating to form a roller.

Figure 3:
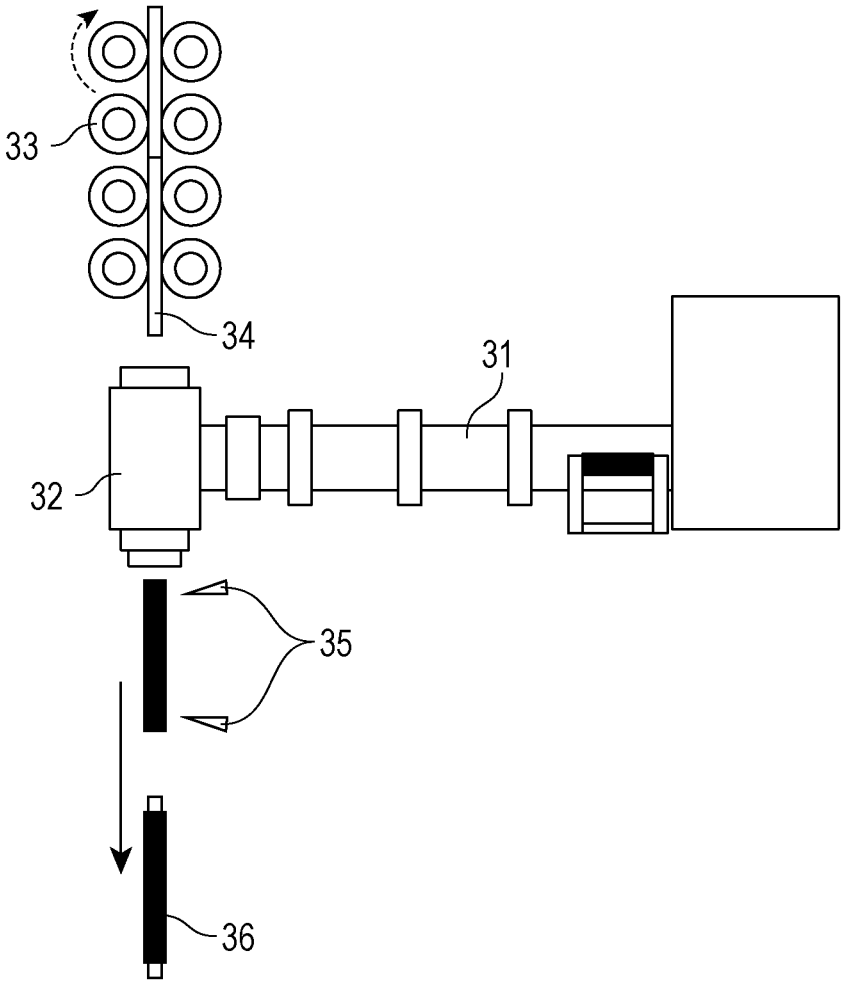
FIG. 3 schematically illustrates an extruder for producing the electrophotographic roller of an embodiment of the present disclosure.

FIG. 3 is an explanatory view illustrating a method for forming a layer of the material for an elastic layer on an outer peripheral surface of a base by extruding the base and the material for the elastic layer together from a crosshead. This method is desirable because it enables easy continuous production of electrophotographic rollers, takes a small number of steps, and is suited to low-cost production. In FIG. 3, an extruder 31 is equipped with a crosshead 32. A base 34 conveyed by base conveying rollers 33 is inserted into the crosshead 32 from above, and a cylindrical rubber material is extruded onto an outer peripheral surface of the base 34, so that an elastic member can be formed. After the cylindrical elastic member is formed on the outer peripheral surface of the base 34, end portions of the elastic member are cut and removed by a cutting and removing device 35. Thus, an elastic roller 36 having an unvulcanized rubber layer, from which peripheral surfaces of the end portions of the base are exposed, can be obtained.

The elastic roller may be heated to vulcanize the unvulcanized rubber layer by using any of an air-heating furnace, a vulcanizer, a hot plate, far and near infrared, an electric furnace, and superheated steam. The elastic roller may also be rotated and pressed against a heated cylindrical or planar member during vulcanization. The elastic layer is preferably vulcanized at a temperature within the range of 140° C. to 230° C. and for a time period within the range of 5 to 120 minutes.

Anchor Portion

In the electrophotographic roller, a part of the material for the elastic layer enters the gap provided in the joint of the cylindrical base, and covers a portion of the inner peripheral surface of the base near the gap to form an anchor portion of the elastic layer. A width t (mm) (a width in the circumferential direction) of the anchor portion on the inner peripheral surface of the base is not particularly limited, and is set in consideration of, for example, the physical property of the rubber material for the elastic layer so that a desired anchor effect is exerted. For example, the width t (mm) of the anchor portion is set to be 0.01 to 1.00 mm, preferably, about 0.05 to 0.5 mm larger than the width of 0.1 mm of the gap on the inner peripheral surface of the base.

The presence state of the anchor portion in the longitudinal direction of the base depends on the presence state of the gap. That is, when the gap is continuously present all over the length of the base, in general, it is desirable that the anchor portion should also be continuously present all over the length of the base. When the gap is discontinuously present in the longitudinal direction of the base, it is desirable that the anchor portion should also be discontinuously present all over the length of the base. It is only necessary that the number and size of anchor portions should be sufficient for exertion of the effect of the present disclosure, and the anchor portions do not always need to be present in all gaps.

To more properly exert the anchor effect, it is desirable to form the anchor portion in the step of applying the material for the elastic layer onto the outer peripheral surface of the base. That is, in the step of applying the material for the elastic layer onto the outer peripheral surface of the base to form a layer of the material for the elastic layer, it is desirable to form an anchor portion by intruding a part of the material for the elastic layer onto the inner peripheral surface of the base through the gap so that the material covers a portion of the inner peripheral surface of the base near the gap.

When the layer of the material for the elastic layer is formed on the outer peripheral surface of the base, an anchor portion of the elastic layer is formed by intruding a part of the material for the elastic layer into the gap present in the joint of the base to cover the portion of the inner peripheral surface of the base near the gap.

To more easily form the anchor portion, for example, the pressure of rubber entering the crosshead from the extruder during extrusion molding or the pressure of rubber inside the die during injection molding or press forming is preferably set within the range of 0.5 to 50.0 MPa, although it depends on the width of the gap in the joint.

In the case that the material for the elastic layer is not in a liquid state, the material may preferably have Mooney viscosity ML(1+4)100° C. according to Japanese Industrial Standard (JIS) K 6300-1:2013, of 5 to 80, more particularly, 5 to 70. The rubber pressure and the Mooney viscosity during molding need to be appropriately selected so that the anchor portion of the elastic layer is formed on the inner peripheral surface of the cylindrical base. To form the anchor portion, it is necessary to make the rubber pressure during molding relatively high, although it depends on the Mooney viscosity of the rubber material for the elastic layer. FIG. 4 illustrates a cross section of the electrophotographic roller of the present disclosure. An anchor portion 45 of an elastic layer is provided to cover a portion of an inner peripheral surface of a base near a gap. The electrophotographic roller is formed by integrally molding a cylindrical base 41 and an elastic layer 42. By the pressure during molding, the rubber material is intruded into a gap 44 that penetrates the base to an inner peripheral surface 43 in the joint, and the rubber material further penetrates the inner peripheral surface 43. By such molding, the anchor portion 45 of the elastic layer, which covers the portion of the inner peripheral surface near the gap, is formed, and the electrophotographic roller of the present disclosure is obtained.

While an adhesive can be used between the cylindrical base and the elastic layer when forming the elastic layer, it is necessary to form a layer of the adhesive so that the adhesive does not close the gap in the joint of the base.

Surface Grinding and Others

While a method for grinding the surface of the electrophotographic roller is not particularly limited, for example, a so-called traverse method in which a grindstone moves for polishing or a plunge method in which a wider grindstone performs collective polishing without moving is adopted. The plunge method is more suitable because it can grind the rubber roller all over the width at a time and this can make the working time shorter than in the traverse method. Even when a great torque is applied to the electrophotographic roller as in the step of performing polishing or grinding while rotating the electrophotographic roller, since the electrophotographic roller of the present disclosure has the anchor portion of the elastic layer, separation of the elastic layer in the gap at the joint of the cylindrical base can be prevented, and misalignment between the base and the elastic layer can be prevented.

To satisfy the characteristics of the electrophotographic roller, the surface of the elastic layer on the outer peripheral surface of the base may be reformed by being irradiated with energy light such as ultraviolet light or an electron beam. Further, a surface layer may be formed by applying coating liquid onto the surface of the elastic layer on the outer peripheral surface of the base. Examples of a coating method can include dipping, spraying, roller coating, blade coating, and ring coating.

Electrophotographic Apparatus

Figure 5:
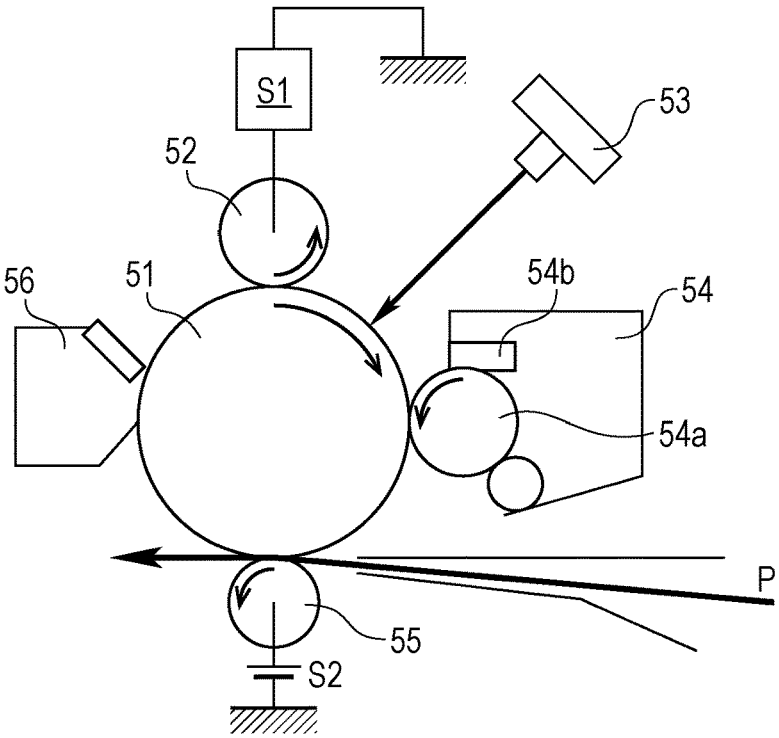
FIG. 5 illustrates an outline configuration of an electrophotographic apparatus in accordance with one or more embodiment of the present disclosure.

FIG. 5 is a schematic view illustrating the outline of an electrophotographic apparatus according to an embodiment of the present disclosure. A photosensitive drum 51 is driven and rotated at a predetermined circumferential velocity (process speed) in the clockwise direction shown by arrow in FIG. 5. For example, the photosensitive drum can include at least a roller-shaped conductive support and a photosensitive layer provided on the conductive support and containing an inorganic photosensitive material or an organic photosensitive material.

A charging unit is composed of a charging roller 52 and a charging-bias application power supply S1 for applying charging bias to the charging roller 52. The charging roller 52 is in contact with the photosensitive member with a predetermined pressing force, and rotates while following rotation of the photosensitive member in this embodiment. When a predetermined direct-current voltage (−1200 V in this embodiment) is applied from the charging-bias application power supply S1 to the charging roller 52, the surface of the photosensitive member (member to be charged) is uniformly charged with a predetermined polarity potential (a dark area potential of −600 V in the embodiment) (DC charging). Instead of DC charging, other known charging methods, such as AC (alternating current voltage)+DC (direct current voltage) charging and injection charging, can be used.

As an exposure unit 53, a known unit can be used. Examples of the exposure unit can include a laser beam scanner and an LED.

When a charged surface of the photosensitive member is subjected by the exposure unit 53 to image exposure corresponding to desired image information, the potential of an exposure light area on the charged surface (a light-area potential of −350 V in the embodiment) selectively decreases (attenuates), so that an electrostatic latent image is formed on the electrophotographic photosensitive member.

As a developing unit 54, a known unit can be used. For example, the developing unit 54 includes a developing roller 54*a* disposed at an opening of a developer container for accommodating toner to bear and convey the toner, an agitating member (not illustrated) for agitating the accommodated toner, and a toner regulating member 54*b* for regulating the amount of toner born on the developing roller 54*a* (toner layer thickness). In the developing unit b 54, toner (negative toner) charged with the same polarity as the charging polarity of the photosensitive member (a developing bias of −350 V in the embodiment) is selectively attached to the exposure light area of the electrostatic latent image on the surface of the photosensitive member, and the electrostatic latent image is thereby visualized as a toner image. The developing method is not particularly limited, and all existing developing methods can be used. While examples of existing developing methods include a jumping developing method, a contact developing method, and a magnetic brush method. Particularly in an electrophotographic apparatus that outputs color images, the developing roller 54*a* using a contact developing method is suitably used, for example, to improve the scattering property of toner.

A transfer roller 55 is in contact with the photosensitive member with a predetermined pressing force to form a transfer nip, and rotates in the forward direction with respect to the rotation of the photosensitive member and at almost the same circumferential velocity as that of the photosensitive member. Also, a transfer voltage having a polarity opposite from the charging polarity of the toner is applied from a transfer-bias application power supply S2 to the transfer roller 55. A recording material P is supplied at a predetermined timing from an unillustrated sheet feeding mechanism to the transfer nip, and a back surface of the recording material P is charged with the polarity opposite from the charging polarity of the toner by the transfer roller 55 to which the transfer voltage is applied. A toner image on the side of the charged photosensitive member is thereby electrostatically transferred onto a front surface of the recording material P at the transfer nip.

After receiving the transferred toner image at the transfer nip, the recording material P separates from the charged photosensitive member, and is introduced into an unillustrated toner-image fixing unit, where the toner image is fixed. Then, the recording material P is output as an image formed material. In a duplex image forming mode or a multiplex image forming mode, the image formed material is introduced into an unillustrated recirculation conveying mechanism, and is introduced to the transfer nip again. Residual substances on the surface of the photosensitive member, such as transfer residual toner, is recovered from the surface of the photosensitive member by a cleaning unit 56 shaped like, for example, a blade.

A process cartridge into which some of the photosensitive member, the charging member, the developing member, the cleaning member, and the toner described above and a toner container and a waste toner container are combined may be removably attached to a main body of an electrophotographic apparatus such as a copying machine or a laser beam printer. The use of the process cartridge allows members that are susceptible to deterioration to be replaced together. Further, toner supply and recovery of waste toner can be performed without causing scattering of toner.

The electrophotographic roller according to the embodiment of the present disclosure can be applied to the rollers used in the electrophotographic apparatus, for example, the charging roller, the developing roller, and the transfer roller.

The electrophotographic roller according to the embodiment of the present disclosure can suppress or prevent misalignment between the cylindrical base and the elastic layer resulting from separation of the elastic layer particularly in the joint of the base. As a result, image density unevenness resulting from misalignment between the base and the elastic roller in the electrophotographic roller is suppressed, and a defect of an electrophotographic image due to the misalignment is avoided.

Embodiments

While the present disclosure will be specifically described below by using embodiments and comparative embodiments, the disclosure is not limited to these embodiments. Prior to descriptions of the embodiments, descriptions will be given of preparation examples of coating liquid for a front surface and evaluation methods for an electrophotographic roller.

First Production Example: Preparation of Coating Liquid 1

Urethane resin was obtained by reacting polycaprolactone-based polyol and tolylene diisocyanate (TDI) and was dissolved in a methyl isobutyl ketone to form a solution so that the resin component became about 27 mass %. Further, 30 mass % of carbon black as a conductive agent relative to the resin component and 50 mass % of acrylic particles relative to the resin component were added to the solution. The solution was sufficiently stirred and dispersed, and Coating Liquid 1 was thereby prepared.

Second Production Example: Preparation of Coating Liquid 2

Urethane resin was obtained by reacting polyether-based polyol and 4,4'-diphenylmethane diisocyanate (MDI) and was dissolved in ethyl methyl ketone to form a solution so that the resin component became about 23 mass %. Further, 20 mass % of carbon black relative to the resin component and 15 mass % of acrylic particles relative to the resin component were added to the solution. The solution was sufficiently stirred and dispersed, and Coating Liquid 2 was thereby prepared.

Image Evaluation 1: Image Evaluation for Charging Roller

The electrophotographic roller is assembled as a charging roller into a process cartridge for black together with an electrophotographic sensitive member in a state in which the electrophotographic roller and the electrophotographic sensitive member are made in pressure contact by applying a load of 500 g to each end of the electrophotographic photosensitive member. Further, the process cartridge is assembled into an electrophotographic apparatus (LBP7200 from Canon Inc.) for longitudinally outputting A4-sized paper, and image evaluation is performed.

Image evaluation is performed in an environment of a temperature of 30° C. and a relative humidity of 80%.

Electrophotographic images are output as follows.

First, one halftone image (an image in which horizontal lines with a width of 1 dot are printed in the direction perpendicular to the rotating direction of the electrophotographic photosensitive member on an A4-sized sheet at an interval of 2 dots in the rotating direction) is output. Next, an image in which the alphabet character "E" with a size of 6 points is drawn (hereinafter also referred to as "E-character image") is continuously printed on 6000 A4-sized sheets so that the print density is 1%, and the sheets are then output. However, one halftone image is output every time 250 E-character images are output.

Then, 25 halftone images thus obtained are visually inspected, the presence or absence of image density unevenness resulting from the electrophotographic roller is visually checked, and evaluation is performed on the following criteria.

However, at a time when a halftone image on which density unevenness is found is output, image output is stopped, and the image evaluation is shifted to evaluation of misalignment between the base and the elastic layer to be described later. When density unevenness is found in the first halftone image, an E-character image is not output, and the image evaluation is shifted to the evaluation of misalignment between the base and the elastic layer to be described later.

Rank A: Density unevenness is not found in any halftone image.

Rank B: Density unevenness is not found in the first halftone image, but density unevenness is found in any of the second and subsequent halftone images.

Rank C: Density unevenness is found in the first halftone image.

Image Evaluation 2: Image Evaluation for Transfer Roller

The electrophotographic roller is assembled as a transfer roller into an electrophotographic apparatus (LBP6240 from Canon Inc.) for longitudinally outputting A4-sized paper, and image evaluation is performed. The image evaluation is performed similarly to Image Evaluation 1.

Image Evaluation 3: Image Evaluation for Developing Roller

The electrophotographic roller is assembled as a developing roller into an electrophotographic apparatus (LBP7200C from Canon Inc.) for longitudinally outputting A4-sized paper, and image evaluation is performed. The image evaluation is performed similarly to Image Evaluation 1.

Evaluation of Misalignment between Base and Elastic Layer

As for the electrophotographic roller ranked as "A" in the image evaluation, after the last halftone image was output, separation between the base and the elastic layer at the interface therebetween and the presence or absence of "misalignment" between the base and the elastic layer resulting from the separation were observed.

As for the electrophotographic roller ranked as "B" in the image evaluation, at a time when a halftone image having density unevenness was first obtained, image output was stopped, and separation between the base and the elastic layer at the interface therebetween and the presence or absence of "misalignment" between the base and the elastic layer resulting from the separation were observed.

As for the electrophotographic roller ranked as "C" in the image evaluation, just after a first halftone image was output, separation between the base and the elastic layer at the interface therebetween and the presence or absence of "misalignment" between the base and the elastic layer resulting from the separation were observed.

Separation of the base and the elastic layer and the presence or absence of "misalignment" therebetween resulting from the separation are checked as follows.

The elastic layer in the electrophotographic roller removed from the process cartridge or the main body of the electrophotographic apparatus is cut with a cutter. In the electrophotographic rollers ranked as B and C, the elastic layer is cut at a position corresponding to the position of density unevenness in the halftone image. In the electrophotographic roller ranked as A, the elastic layer is cut at three positions into four parts in the direction along the axis of the electrophotographic roller. After cutting, the presence or absence of misalignment due to separation of the base and the elastic layer at the interface is visually checked, and the check result is displayed on the following criteria.

Absence: Misalignment due to separation at the contact portion between the base and the elastic layer is not found.

Presence: Misalignment due to separation at the contact portion between the base and the elastic layer is found.

First Embodiment

Materials in column Component (1) of Table 1 below were mixed for 15 minutes by using a 6-liter pressure kneader. Next, materials in column Component (2) of Table 1 below were added, and the materials of columns (1) and (2) were kneaded for 15 minutes by an open roll to produce an unvulcanized rubber composition.

TABLE 1

| | Materials | Parts by mass |
|---|---|---|
| Component (1) | NBR (trade name: "JSR N230SV", from JSR Corporation) | 1100 |
| | Carbon black (trade name: "SEAST600", from Tokai Carbon Co., Ltd.) | 45 |
| | Zinc stearate (trade name: "ZINC STEARATE", from NOF CORPORATION) | 1 |
| | Zinc oxide (trade name: "Zinc Oxide No. 2", from Sakai Chemical Industry Co., Ltd.) | 5 |
| | Calcium carbonate (trade name: "SUPER#2300", from Maruo Calcium Co., Ltd.) | 20 |
| Component (2) | Vulcanization accelerator (TBzTD) | 4.5 |
| | Sulfur as vulcanizer | 1.2 |

Figure 6A:
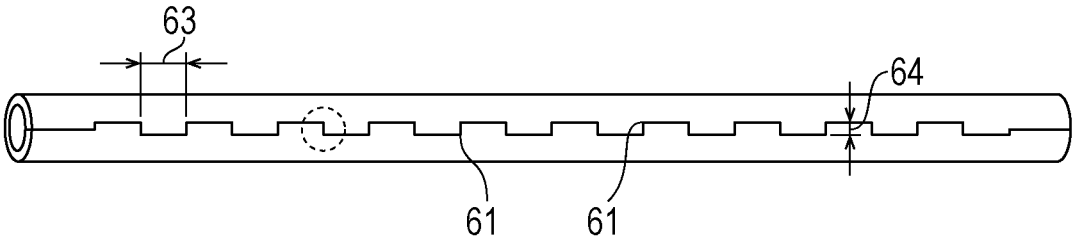
FIG. 6A is a schematic view of a joint (comb tooth shape) of a cylindrical base according to an embodiment.
Figure 6B:
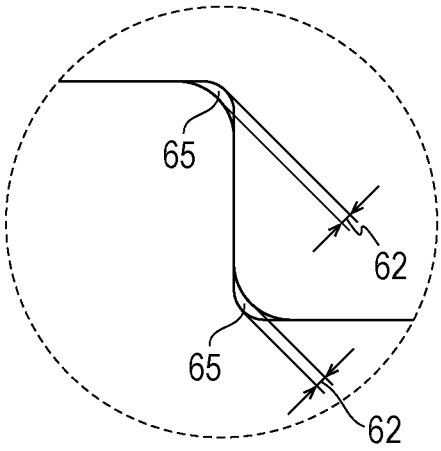
FIG. 6B is an enlarged partial view of the joint of FIG. 6A.

On the other hand, a cylindrical base made of stainless steel and having an outer diameter of 6 mm and a length of 252 mm was prepared. The cylindrical base was produced by forming a stainless steel flat plate having a thickness of 0.6 mm into a cylindrical shape by press working, and a joint had a comb tooth shape, as illustrated in a schematic view of FIG. 6A. Corner portions 61 of the comb tooth shape had gaps 65 illustrated in FIG. 6B, and a width 62 of the gaps 65 was 0.1 mm. The number of irregularities of crests and troughs of the comb tooth shape was 20, an interval 63 between the teeth in the longitudinal direction was 11 mm, and a protrusion amount 64 of the crests and troughs in the circumferential direction was 2 mm. On an outer peripheral surface of the base, an adhesive (trade name: "METALOC N", from TOYOKAGAKU KENKYUSHO C., Ltd.) was applied to bond the base and the elastic layer. An adhesive layer having a thickness of 3 μm was formed so as not to close the gaps in the joint of the base.

Next, an unvulcanized roller having an outer diameter of 8.8 mm was molded by integrally extruding the cylindrical base and the unvulcanized rubber composition by using a crosshead attached-extruder. The used extruder had a cylinder diameter of 45 mm and a ratio L/D of 20. The temperatures of a head, a cylinder, and a screw during extrusion were each controlled to 90° C. The Mooney viscosity (JIS K6300-1:2013) of the rubber material was 50. Further, the rubber pressure during extrusion (pressure of rubber entering into the crosshead from the extruder) was adjusted to 20 MPa. The rubber pressure refers to the pressure during extrusion (extruder side) at one metal mesh (No. 100 mesh, wire diameter of 100 μm, from IGETA, Inc.) disposed between the extruder and the crosshead.

Both ends of the formed unvulcanized roller were cut so that the axial width of the elastic layer became 230 mm. After that, a vulcanized roller was obtained by performing heating and vulcanization for 1 hour at 160° C. Further, a crown-shaped vulcanized roller having a center portion outer diameter of 8.5 mm and an end portion outer diameter of 8.3 mm was obtained by dry polishing using a rotary grindstone in a plunge polisher. A surface of the vulcanized roller was irradiated with ultraviolet light having a wavelength of 254 nm by a low-pressure mercury lamp manufactured by HARISON TOSHIBA LIGHTING CORPORATION so that the integral light quantity became 9000 mJ/cm$^2$. Thus, an electrophotographic roller No. 1 was obtained.

The electrophotographic roller No. 1 was assembled as a charging roller into the electrophotographic apparatus, and Image Evaluation 1 was performed. Also, evaluation of misalignment was performed. As a result of Image Evaluation 1, the electrophotographic roller No. 1 was ranked as A, and misalignment was not found in the contact portion between the base and the elastic layer.

Detailed information about measurement of the Mooney viscosity is as follows:

a) Standard No.: JIS K6300-1:2013 b) Type and collection and forming methods of test piece: a disc-shaped piece having a diameter of 50 mm and a thickness of 6 mm (conforming to JIS K6300-1:2013)

c) Model of test apparatus: Model SMV-200, from Shimadzu Corporation d) Test temperature: 100.0±0.5° C.

e) Type of rotor: L type

Second Embodiment

As a base, a cylindrical base made of stainless steel and having a comb tooth shape similar to that of the first embodiment was used. The sizes of portions of the comb tooth shape are shown in Table 3. An electrophotographic roller No. 2 was obtained similarly to the first embodiment except that an elastic layer was formed without providing an adhesive layer between the base and an elastic layer. Further, Image Evaluation 1 and misalignment evaluation were performed similarly to the first embodiment. The evaluation results are shown in Table 3.

Third Embodiment

Figure 7A:
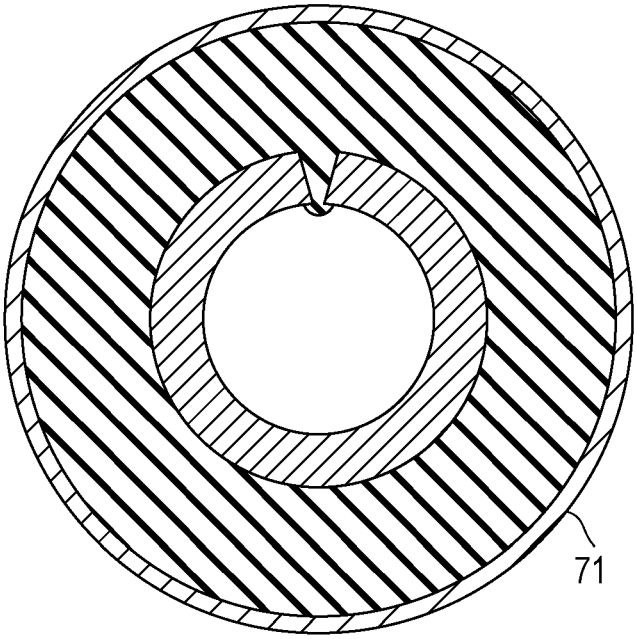
FIG. 7A is a schematic cross-sectional view of an electrophotographic roller according to another embodiment.

As a base, a cylindrical base made of stainless steel and having a comb tooth shape similar to that of the first embodiment was used. The sizes of portions of the comb tooth shape are shown in Table 3. A surface layer having a thickness of 15 μm was formed by applying coating liquid 1 onto a surface of an elastic layer after formation of the elastic layer, and the material was set by air drying for 30 minutes at room temperature and further drying using a hot-air circulating drier for 1 hour at a temperature of 160° C. As a result, an electrophotographic roller No. 3 was obtained similarly to the first embodiment except for the above steps. Further, Image Evaluation 1 and misalignment evaluation were performed similarly to the first embodiment. The evaluation results are shown in Table 3. FIG. 7A is a schematic cross-sectional view of the electrophotographic roller No. 3. Reference numeral 71 denotes a surface layer.

Fourth Embodiment

Materials in column Component (1) of the following Table 2 were mixed for 7 minutes by using a 6-liter pressure kneader. Further, materials in column Component (2) of Table 2 were added, and the materials of columns (1) and (2) were kneaded for 15 minutes by an open roll, so that an unvulcanized rubber composition was produced.

TABLE 2

| | Materials | Parts by mass |
|---|---|---|
| Component (1) | NBR (trade name: "Nipol DN401LL", from Zeon Corporation) | 70 |
| | Epichlorohydrin/ethylene oxide/allyl glycidyl ether terpolymer (trade name: "EPICHLOMER CG102", from Daiso Co., Ltd.) | 30 |
| | Carbon black (trade name: "Asahi #35G", from ASAHI CARBON CO., LTD.) | 40 |
| | Zinc stearate (trade name: "ZINC STEARATE", from NOF CORPORATION) | 3 |
| | Stearate (trade name: "Stearic acid Tsubaki", from NOF CORPORATION) | 1 |
| Component (2) | OBSH with median diameter of 3.3μm (trade name: "NEOCELLBORN-N-1000M", from EIWA CHEMICAL IND. CO., LTD) | 1.5 |
| | OBSH with median diameter of 14.1 μm (trade name: "NEOCELLBORN-N-1000S", from EIWA CHEMICAL IND. CO., LTD) | 0.5 |
| | Dibenzothyazyl disulfide (trade name: "NOCCELER-DM-P", from OUCHI SHINKO CHEMICAL INDUSTRIAL CO., LTD.) | 1.5 |
| | Tetraethylthiuram disulfide (trade name: "NOCCELER-TET-G", from OUCHI SHINKO CHEMICAL INDUSTRIAL CO., LTD.) | 2 |
| | Sulfur (trade name: "Sulfax PMC", from Thurumi Chemical Industry Co., Ltd.) | 3 |

On the other hand, a cylindrical base made of stainless steel and having an outer diameter of 5 mm and a length of 240 mm was prepared. The cylindrical base was obtained by forming a stainless steel flat plate having a thickness of 0.6 mm into a cylindrical shape by press working, and a joint had a comb tooth shape similarly to the first embodiment. The sizes of portions of the comb tooth shape are shown in Table 3.

Figure 7B:
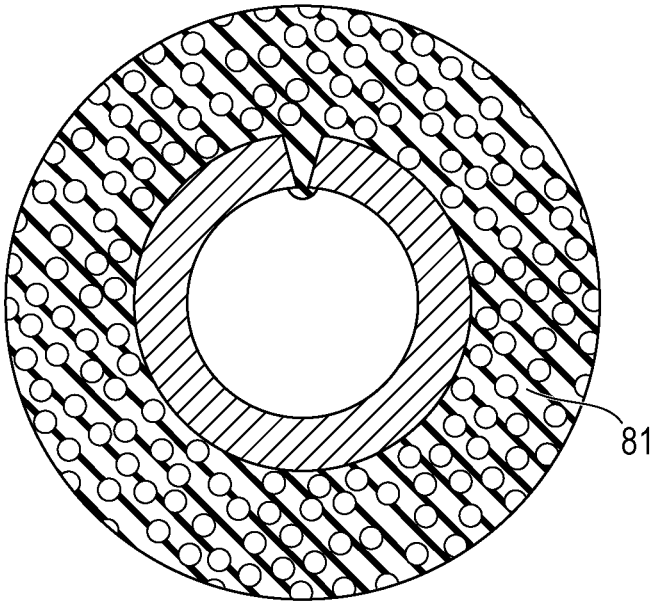
FIG. 7B is a schematic cross-sectional view of an electrophotographic roller according to yet another embodiment.

Next, an unvulcanized roller having an outer diameter of 10.0 mm was molded by integrally extruding the cylindrical base and the unvulcanized rubber composition by using a crosshead attached-extruder, similarly to the first embodiment. The used extruder had a cylinder diameter of 45 mm and a ratio L/D of 20. The temperatures of a head, a cylinder, and a screw were each controlled to 50° C. during extrusion. The extrusion pressure during extrusion was adjusted to 20 MPa. After the molded unvulcanized roller was heated and vulcanized for 30 minutes at 200° C. by an electric furnace, both end portions of an elastic layer were cut, so that a vulcanized foamed roller having an axial length of 216 mm was obtained. An electrophotographic roller No. 4 having an outer diameter of 12.5 mm was obtained by further subjecting the vulcanized foamed roller to dry polishing using a rotary grindstone in a plunge polisher. FIG. 7B is a schematic cross-sectional view of the electrophotographic roller No. 4. Reference numeral 81 denotes a foamed elastic layer. The electrophotographic roller No. 4 was assembled as a transfer roller into the electrophotographic apparatus, and Image Evaluation 2 was performed. Also, misalignment evaluation was performed similarly to the first embodiment. The evaluation results are shown in Table 3.

Fifth Embodiment

A cylindrical base made of stainless steel and having an outer diameter of 6 mm and a length of 252 mm was prepared similarly to the first embodiment. A joint of this base has a comb tooth shape similarly to the first embodiment. The sizes of portions of the comb tooth shape are shown in Table 3. On an outer peripheral surface of the base, an adhesive (trade name: Primer X-33-173, from Shin-Etsu Chemical Co., Ltd.) was applied to bond the base to an elastic layer. An adhesive layer had a thickness of 5 μm, and was formed so as not to close gaps in a joint of the base.

By using this base, a cylindrical die and two cylindrical plugs for holding the base in the cylindrical die were assembled, and the cylindrical die was clamped by a heating hot plate divided parallel to the longitudinal direction of the cylindrical die, and was heated to 150° C. After a conductive silicone rubber material (trade name: "DY35-11" from Dow Corning Toray Co., Ltd.) was injected into the cylindrical die by injection molding, it was set by heating for 15 minutes, and was then released from the die. After that, the conductive silicone rubber material was further set by being heated for 4 hours at 200° C. in an electric furnace. Thus, a vulcanized roller in which a rubber layer was provided on the outer peripheral surface of the base was obtained. The rubber pressure inside the die during injection molding was 0.5 MPa. A surface layer having a thickness of 20 μm was formed by applying coating liquid 2 on the surface of the vulcanized roller, was dried by air for about 30 minutes at room temperature, and was further dried for 4 hours at a temperature of 140° C. in a hot-air circulating drier to set the material. Thus, an electrophotographic roller No. 5 was obtained. Polishing was not performed.

The electrophotographic roller No. 5 was assembled as a developing roller into the electrophotographic apparatus, and Image Evaluation 3 was performed. Also, misalignment evaluation was performed similarly to the first embodiment. The evaluation results are shown in Table 3.

Sixth Embodiment

Figure 8A:
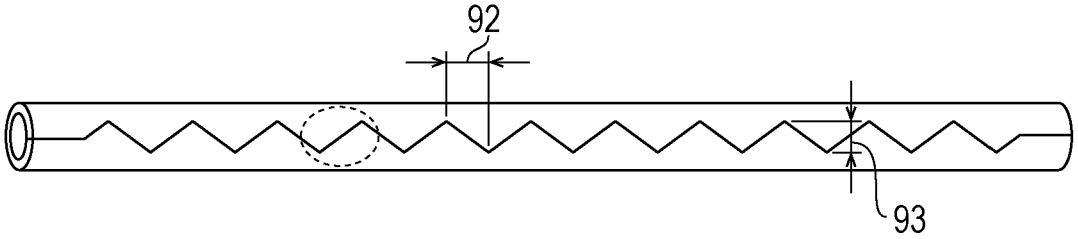
FIG. 8A is a schematic view of a joint (sawtooth shape) of a cylindrical base according to an embodiment.
Figure 8B:
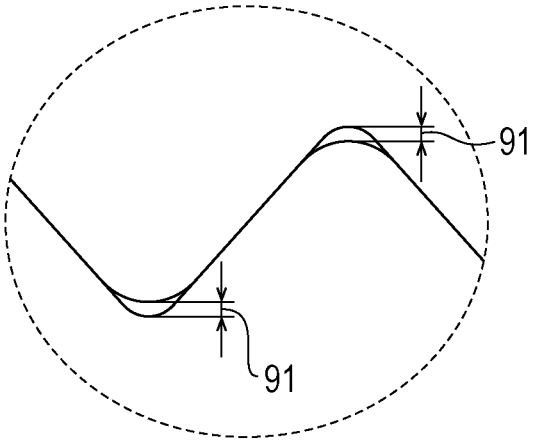
FIG. 8B is an enlarged partial view of the joint of FIG. 8A.

As a base, a cylindrical base made of stainless steel and having a joint with a sawtooth shape, as illustrated in schematic views of FIGS. 8A and 8B, was used. Gaps were provided at crests and troughs of the sawtooth shape. A width 91 of the gaps was 0.2 mm, the number of irregularities of crests and troughs of the sawtooth shape was 22, an interval 92 between the crests and troughs in the longitudinal direction was 10 mm, and a protrusion amount 93 of the crests and troughs in the circumferential direction was 2 mm. An electrophotographic roller No. 6 was obtained similarly to the first embodiment except for the above points, and was subjected to evaluation. The evaluation results are shown in Table 3.

Seventh Embodiment

As a base, a cylindrical base made of stainless steel and having a joint with a sawtooth shape similarly to the sixth embodiment was used. The sizes of portions of the sawtooth shape are shown in Table 3. An electrophotographic roller No. 7 was obtained similarly to the first embodiment except for the above point, and was subjected to evaluation. The evaluation results are shown in Table 3.

Eighth Embodiment

Figure 9A:
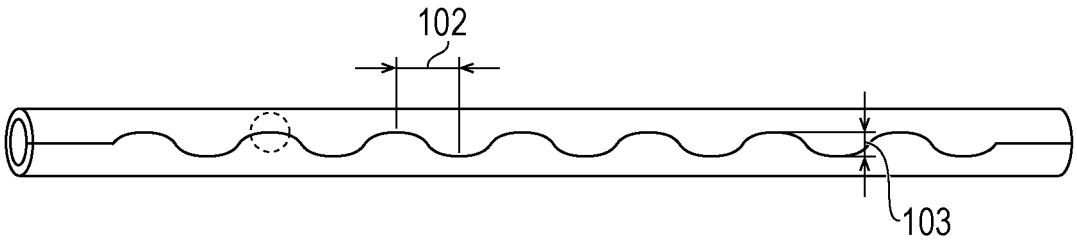
FIG. 9A is a schematic view of a joint (arc tooth shape) of a cylindrical base according to an embodiment of the present disclosure.
Figure 9B:
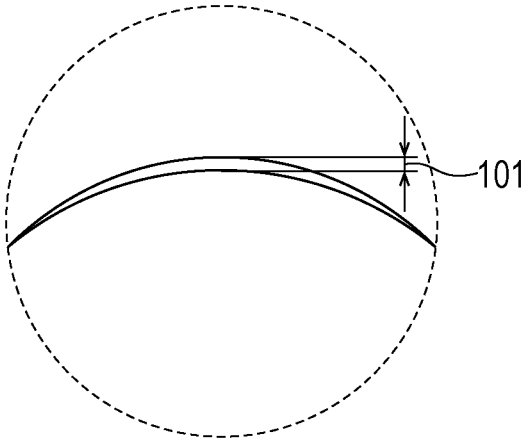
FIG. 9B is an enlarged partial view of the joint of FIG. 9A.

As a base, a cylindrical base made of stainless steel and having a joint with an arc tooth shape, as illustrated in schematic views of FIGS. 9A and 9B, was used. Gaps were provided at peaks of crests and troughs in the arc tooth shape. A width 101 of the gaps was 0.1 mm, the number of irregularities of crests and troughs in the arc tooth shape was 15, an interval 102 between the crests and troughs in the longitudinal direction was 15 mm, and a protrusion amount 103 of the crests and troughs in the circumferential direction was 3 mm. An electrophotographic roller No. 8 was obtained similarly to the first embodiment except for the above points, and was subjected to evaluation. The evaluation results are shown in Table 3.

Ninth Embodiment

As a base, a cylindrical base made of stainless steel and having a joint with an arc tooth shape, similarly to the eighth embodiment, was used. The sizes of portions of the arc tooth shape are shown in Table 3. An electrophotographic roller No. 9 was obtained similarly to the first embodiment except for the above points, and was subjected to evaluation.

Tenth Embodiment

As a base, a cylindrical base made of stainless steel and having a straight joint linearly extending in the longitudinal direction was used. The straight joint partly had gaps except for both end portions of the base, and the width of the gaps was 0.1 mm. An electrophotographic roller No. 10 was obtained similarly to the first embodiment except for the above points, and was subjected to evaluation, similarly to the first embodiment. The evaluation results are shown in Table 3.

First Comparative Embodiment

As a base, a cylindrical base made of stainless steel and having the same comb tooth shape and the same gaps as those of the first embodiment was used. After the unvulcanized rubber composition of the first embodiment was extruded in the shape of a cylindrical tube by using an extruder, the cylindrical tube was cut to have an axial width of 230 mm, and was subjected to heating and vulcanization for 1 hour at 160° C. By further inserting the cylindrical base into the cylindrical tube, a vulcanized roller was obtained. This vulcanized roller was subjected to dry polishing using a rotary grindstone in a plunge polisher, and a crown-shaped electrophotographic roller No. 11 having a center portion outer diameter of 8.5 mm and an end portion outer diameter of 8.3 mm was obtained. The electrophotographic roller No. 11 was assembled as a charging roller into the electrophotographic apparatus, and was subjected to Image Evaluation 1. The electrophotographic roller No. 11 was ranked as C in the image evaluation.

When misalignment between the base and the elastic layer at an interface therebetween was checked because the result of Image Evaluation 1 was rank C, "misalignment" resulting from separation of the base and the elastic layer was found. This is considered because the elastic layer was separated in the joint of the cylindrical base by the load of rotation in the polishing step of the production process for the electrophotographic roller and the separation caused misalignment between the base and the elastic layer.

Second Comparative Embodiment

An electrophotographic roller No. 12 was obtained by a method similar to that of the fifth embodiment except that a cylindrical stainless steel base had the same comb tooth shape as that of the first embodiment, but no gaps penetrating the base in the thickness direction were provided in a joint of the base. In this electrophotographic roller No. 12, a rubber material that forms an elastic layer enters the joint, but penetrating gaps are not provided. Hence, anchor portions of the elastic layer are not provided on an inner peripheral surface of the cylindrical base.

The electrophotographic roller No. 12 was assembled as a developing roller into the electrophotographic apparatus, and was subjected to Image Evaluation 3 similarly to the fifth embodiment. As a result of the evaluation, the electrophotographic roller No. 12 was ranked as B. When misalignment between the base and the elastic layer at an interface therebetween was checked, "misalignment" resulting from separation of the base and the elastic layer was found. This is considered because the misalignment was caused by the torque of rotation for a long period inside the electrophotographic apparatus.

Third Comparative Embodiment

Figure 10A:
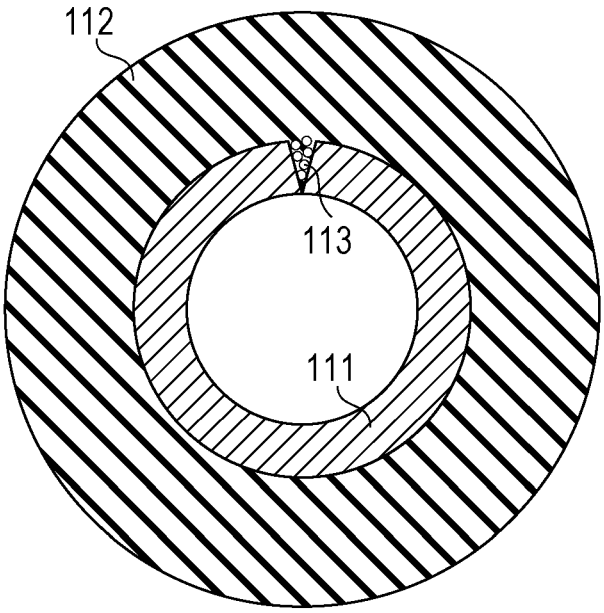
FIG. 10A is a schematic cross-sectional view of an electrophotographic roller according to a comparative embodiment.

An electrophotographic roller No. 13 was obtained by a method similar to that of the fifth embodiment except that an elastic layer was formed after inorganic particles are put and retained in gaps at a joint of a stainless steel cylindrical base having the same comb tooth shape and the same gaps as those of the first embodiment. In the electrophotographic roller No. 13, a rubber material that forms the elastic layer enters the joint, but the gaps at the joint are closed by the inorganic particles. Hence, anchor portions of the elastic layer are not formed on an inner peripheral surface of the cylindrical base. FIG. 10A is a cross-sectional view of the electrophotographic roller No. 13. Reference numerals 111, 112, and 113 respectively denote the cylindrical base, the elastic layer, and the inorganic particles.

The electrophotographic roller No. 13 was assembled as a developing roller into the electrophotographic apparatus, and was subjected to Image Evaluation 3 similarly to the fifth embodiment. As a result of the image evaluation, the electrophotographic roller No. 13 was ranked as B. When misalignment between the base and the elastic layer at an interface therebetween was checked, "misalignment" resulting from separation of the base and the elastic layer was found. This is considered because the misalignment was caused by the torque of rotation for a long period inside the electrophotographic apparatus.

Fourth Comparative Embodiment

Figure 10B:
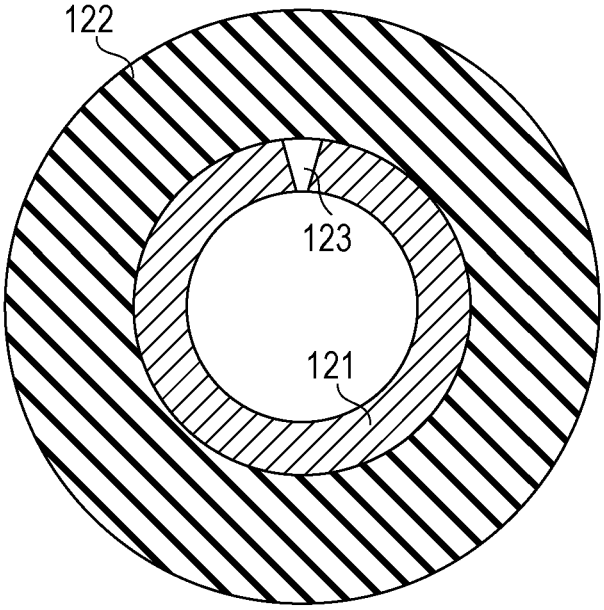
FIG. 10B is a schematic cross-sectional view of an electrophotographic roller according to another comparative embodiment.

An electrophotographic roller No. 14 was obtained by a method similar to that of the first embodiment except that epoxy resin (filler) was filled and retained as putty in a joint and gaps of a stainless steel cylindrical base having the same comb tooth shape and the same gaps as those of the first embodiment. In the electrophotographic roller No. 14, a rubber material that forms the elastic layer does not enter the joint, and anchor portions of the elastic layer are not formed on an inner peripheral surface of the cylindrical base. FIG. 10B is a cross-sectional view of the electrophotographic roller No. 14. Reference numerals 121, 122, and 123 respectively denote the cylindrical base, the elastic layer, and the filler.

The electrophotographic roller No. 14 was assembled as a charging roller into the electrophotographic apparatus, and was subjected to Image Evaluation 1 similarly to the first embodiment. As a result of the image evaluation, the electrophotographic roller No. 14 was ranked as C. When misalignment at a contact portion between the base and the elastic layer was checked, it was found. This is considered because the elastic layer separated in the joint of the cylindrical base by the load of rotation in the polishing step of the production process for the electrophotographic roller and the separation caused misalignment between the base and the elastic layer.

Study of Evaluation Results

In the electrophotographic rollers of the first and fourth comparative embodiments, great misalignment occurred between the elastic member and the cylindrical base because the elastic member did not enter the joint of the cylindrical base. In the electrophotographic rollers of the second and third comparative embodiments, the rubber material for the elastic layer entered the joint, but anchor portions of the elastic layer were not formed in the inner peripheral surface of the base. Hence, the elastic member and the cylindrical base were misaligned, and this affected images.

In contrast, in the electrophotographic rollers of the first to tenth embodiments, a part of the material for the elastic layer enters the gaps from the joint of the cylindrical base, and covers the inner peripheral surface of the base near the gaps to form the anchor portions. As a result, even when a great torque is received during rotation, it is possible to suppress separation particularly in the joint of the cylindrical base and to prevent misalignment between the base and the elastic layer. This can reduce image density unevenness.

TABLE 3

| | Cylindrical base | | | | | Misalignment evaluation | | Mooney | | |
|---|---|---|---|---|---|---|---|---|---|---|
| | Joint shape | Gap width (mm) | Number of irregularities | Interval between teeth (mm) | Protrusion amount (mm) | Immediately after start of evaluation | After long use | Viscosity [ML(1 + 4) 100° C.] | Image evaluation | Remarks |
| Embodiment 1 | Comb tooth shape | 0.1 | 20 | 11 | 2 | Not found | Not found | 65 | A (Charging roller) | Integral extrusion molding of elastic layer |
| Embodiment 2 | | 0.1 | 30 | 7.5 | 3 | Not found | Not found | 65 | A (Charging roller) | Integral extrusion molding of elastic layer, no adhesive |
| Embodiment 3 | | 0.2 | 20 | 11 | 1 | Not found | Not found | 65 | A (Charging roller) | Integral extrusion molding of elastic layer, with surface layer |
| Embodiment 4 | | 0.1 | 20 | 11 | 2 | Not found | Not found | 22 | A (Transfer roller) | Integral extrusion molding of elastic layer, foamed elastic layer |
| Embodiment 5 | | 0.5 | 20 | 11 | 2 | — | Not found | The material was in a liquid state. | A (Developing roller) | Integral extrusion molding of elastic layer |
| Embodiment 6 | Sawtooth shape | 0.2 | 22 | 10 | 2 | Not found | Not found | 65 | A (Charging roller) | Integral extrusion molding of elastic layer |
| Embodiment 7 | | 0.05 | 44 | 5 | 1 | Not found | Not found | 65 | A (Charging roller) | Integral extrusion molding of elastic layer |
| Embodiment 8 | Arc tooth shape | 0.1 | 15 | 15 | 3 | Not found | Not found | 65 | A (Charging roller) | Integral extrusion molding of elastic layer |
| Embodiment 9 | | 0.08 | 7 | 30 | 2 | Not found | Not found | 65 | A (Charging roller) | Integral extrusion molding of elastic layer |
| Embodiment 10 | Straight shape | 0.1 | — | — | — | Not found | Not found | 65 | A (Charging roller) | Integral extrusion molding of elastic layer |
| Comparative embodiment 1 | Comb tooth shape | 0.1 | 20 | 11 | 2 | Found | — | 65 | C (Charging roller) | Base insertion after extrusion molding of tube No anchor portion |
| Comparative embodiment 2 | | 0.1 | 20 | 11 | 2 | — | Found | The material was in a liquid state. | B (Developing roller) | No penetrating gap, no anchor portion |
| Comparative embodiment 3 | | 0.1 | 20 | 11 | 2 | — | Found | The material was in a liquid state. | B (Developing roller) | Inorganic particles in gap, no anchor portion |
| Comparative embodiment 4 | | 0.1 | 20 | 11 | 2 | Found | — | 65 | C (Charging roller) | Filler in joint and gap, no anchor portion |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-240440, filed Dec. 9, 2015, which is hereby incorporated by reference herein in its entirety.

What is claimed is:

1. An electrophotographic roller comprising a cylindrical base and an elastic layer on an outer peripheral surface of the base, wherein a material of the cylindrical base includes metal or metal alloy, the elastic layer contains a rubber, the base has a joint extending from one end to the other end in a longitudinal direction thereof, at least a part of the joint has a gap penetrating the base in a thickness direction of the base, and the rubber enters the gap and covers a portion of an inner peripheral surface of the base near the gap to form an anchor portion of the elastic layer, the inner peripheral surface being opposed to an outer surface of the electrophotographic roller.

2. An electrophotographic roller comprising a cylindrical base and an elastic layer on an outer peripheral surface of the base, wherein the elastic layer contains a rubber, the base has a joint extending from one end to the other end in a longitudinal direction thereof, at least a part of the joint has a gap penetrating the base in a thickness direction of the base, and the rubber enters the gap and covers a portion of an inner peripheral surface of the base near the gap to form an anchor portion of the elastic layer, the inner peripheral surface being opposed to an outer surface of the electrophotographic roller, and wherein the joint has a comb tooth shape, and the gap is provided in a corner portion of the comb tooth shape.

3. A production method for an electrophotographic roller including a cylindrical base and an elastic layer provided on an outer peripheral surface of the base, the elastic layer containing a rubber, the base having a joint extending from one end to the other end in a longitudinal direction thereof, at least a part of the joint having a gap penetrating the base in a thickness direction of the base, and the rubber entering the gap and covering a portion of an inner peripheral surface of the base near the gap to form an anchor portion of the elastic layer, the inner peripheral surface being opposed to an outer surface of the electrophotographic roller, wherein the production method comprises:

(A) providing the base having a joint from one end to the other end in a longitudinal direction thereof, wherein at least a part of the joint has a gap penetrating the base in a thickness direction of the base; and (B) applying a material for the elastic layer containing an unvulcanized form of the rubber onto the outer peripheral surface of the base and forming a layer of the material for the elastic layer, wherein step (B) includes forming the anchor portion of the elastic layer by intruding a part of the material for the elastic layer into the inner peripheral surface side of the base through the gap to cover the portion of the inner peripheral surface of the base near the gap, the inner peripheral surface being opposed to an outer surface of the electrophotographic roller.

4. The production method for the electrophotographic roller according to claim 3, wherein step (A) includes forming the base by press working of a metal plate.

5. The production method for the electrophotographic roller according to claim 3, wherein step (B) includes applying the material for the elastic layer onto the outer peripheral surface of the base by crosshead extrusion molding to integrally mold the base and the material for the elastic layer.

6. An electrophotographic apparatus comprising:

an electrophotographic roller including:

a cylindrical base and an elastic layer on an outer peripheral surface of the base, wherein the elastic layer contains a rubber, the base has a joint extending from one end to the other end in a longitudinal direction thereof, at least a part of the joint has a gap penetrating the base in a thickness direction of the base, the rubber enters the gap and covers a portion of an inner peripheral surface of the base near the gap to form an anchor portion of the elastic layer, the inner peripheral surface being opposed to an outer surface of the electrophotographic roller, and wherein the joint has a comb tooth shape, and the gap is provided in a corner portion of the comb tooth shape.

7. An electrophotographic roller comprising a cylindrical base and an elastic layer on an outer peripheral surface of the base, wherein the base has a joint extending from one end to the other end in a longitudinal direction thereof, at least a part of the joint has a gap penetrating the base in a thickness direction of the base, a part of the elastic layer enters the gap and covers a portion of an inner peripheral surface of the base near the gap to form an anchor portion to prevent the elastic layer from separating from the base, the inner peripheral surface being opposed to an outer surface of the electrophotographic roller, and wherein the joint has a comb tooth shape, and the gap is provided in a corner portion of the comb tooth shape.

8. A process cartridge comprising an electrophotographic roller, wherein the electrophotographic roller comprises a cylindrical base and an elastic layer on an outer peripheral surface of the base, the elastic layer contains a rubber, the base has a joint extending from one end to the other end in a longitudinal direction thereof, at least a part of the joint has a gap penetrating the base in a thickness direction of the base, the rubber enters the gap and covers a portion of an inner peripheral surface of the base near the gap to form an anchor portion of the elastic layer, the inner peripheral surface being opposed to an outer surface of the electrophotographic roller, and wherein the joint has a comb tooth shape, and the gap is provided in a corner portion of the comb tooth shape.

9. A process cartridge comprising an electrophotographic roller, wherein the electrophotographic roller comprises a cylindrical base and an elastic layer on an outer peripheral surface of the base, a material of the cylindrical base includes metal or metal alloy, the elastic layer contains a rubber, the base has a joint extending from one end to the other end in a longitudinal direction thereof, at least a part of the joint has a gap penetrating the base in a thickness direction of the base, and the rubber enters the gap and covers a portion of an inner peripheral surface of the base near the gap to form an anchor portion of the elastic layer, the inner peripheral surface being opposed to an outer surface of the electrophotographic roller.

* * * * *